US009899177B2

(12) United States Patent
Lee

(10) Patent No.: US 9,899,177 B2
(45) Date of Patent: Feb. 20, 2018

(54) DELAY TIME GENERATION APPARATUS FOR AIR CIRCUIT BREAKER

(71) Applicant: LSIS CO., LTD., Anyang-si, Gyeonggi-do (KR)

(72) Inventor: Kyuho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/299,392

(22) Filed: Oct. 20, 2016

(65) Prior Publication Data

US 2017/0186580 A1 Jun. 29, 2017

(30) Foreign Application Priority Data

Dec. 28, 2015 (KR) ..... 10-2015-0187794

(51) Int. Cl.

| | |
|---|---|
| ***H01H 7/00*** | (2006.01) |
| ***H01H 77/10*** | (2006.01) |
| ***H01H 71/44*** | (2006.01) |
| *H01H 71/46* | (2006.01) |

(52) U.S. Cl.

CPC ..... *H01H 77/10* (2013.01); *H01H 71/44* (2013.01); *H01H 71/465* (2013.01)

(58) Field of Classification Search

CPC ..... H01H 5/00; H01H 77/10
USPC ..... 335/59
See application file for complete search history.

(56) References Cited

U.S. PATENT DOCUMENTS 4,387,356 A * 6/1983 Takemura ..... H01H 71/52 335/21
4,514,709 A * 4/1985 Nakano ..... H01H 73/18 335/201
4,523,164 A * 6/1985 Aoyama ..... H01H 71/2409 335/16
4,529,951 A * 7/1985 Youichi ..... H01H 71/04 335/13
4,536,726 A * 8/1985 Hideo ..... H01H 71/1027 335/23
4,612,528 A * 9/1986 Peter ..... H01H 71/08 335/13
4,716,392 A * 12/1987 Nakano ..... H01H 71/527 335/189

(Continued)

FOREIGN PATENT DOCUMENTS

EP 1208626 B1 7/2003
EP 1744338 1/2007

(Continued)

OTHER PUBLICATIONS

Korean Intellectual Property Office Application Serial No. 10-2015-0187794, Search Report dated Apr. 14, 2016, 3 pages.
Korean Intellectual Property Office Application No. 10-2015-0187794, Office Action dated Nov. 30, 2016, 5 pages.

(Continued)

*Primary Examiner* — Shawki S Ismail
*Assistant Examiner* — Lisa Homza
(74) *Attorney, Agent, or Firm* — K&L Gates LLP

(57) ABSTRACT

A delay time generation apparatus for an air circuit breaker according to the present invention can provide an effect of ensuring a delay time as long as possible even in a narrow space upon outputting a signal related to a conductive state, by virtue of interaction of a main shaft, a pin portion, a first rotating unit, a second rotating unit and a spring member.

10 Claims, 8 Drawing Sheets

(56) References Cited

U.S. PATENT DOCUMENTS

| | | | | | |
|---|---|---|---|---|---|
| RE32,882 | E * | 3/1989 | Yokoyama | H01H 71/04 | 335/14 |
| 5,023,416 | A * | 6/1991 | Oyama | H01H 1/22 | 200/244 |
| 5,199,553 | A * | 4/1993 | Shinohara | H01H 1/023 | 200/265 |
| 5,909,164 | A * | 6/1999 | Lee | H01H 71/7418 | 335/132 |
| 6,472,627 | B1 * | 10/2002 | Yoon | H01H 3/30 | 200/400 |
| 6,864,450 | B1 | 3/2005 | Chen et al. | | |
| 8,119,942 | B2 | 2/2012 | Yang et al. | | |
| 2002/0056631 | A1 * | 5/2002 | Ohtsuka | H01H 3/3042 | 200/400 |
| 2012/0193201 | A1 | 8/2012 | Knospe et al. | | |
| 2013/0168213 | A1 * | 7/2013 | Kim | H01H 3/04 | 200/322 |

FOREIGN PATENT DOCUMENTS

| | | | |
|---|---|---|---|
| EP | 2015339 | A1 | 1/2009 |
| EP | 2015340 | A2 | 1/2009 |
| JP | 1995-066723 | | 3/1995 |
| JP | 2006100220 | A * | 4/2006 |
| JP | 2009021248 | A | 1/2009 |
| JP | 5275301 | | 8/2013 |
| JP | 5604414 | | 10/2014 |
| KR | 100854387 | | 9/2008 |
| KR | 100876412 | | 12/2008 |
| WO | 2007010608 | | 1/2007 |

OTHER PUBLICATIONS

European Patent Office Application Serial No. 1618949.8, Search Report dated May 30, 2017, 9 pages.

Japanese Office Action for related Japanese Application No. 2016-201522; action dated Oct. 31, 2017; (2 pages).

* cited by examiner

DELAY TIME GENERATION APPARATUS FOR AIR CIRCUIT BREAKER

CROSS-REFERENCE TO RELATED APPLICATION

Pursuant to 35 U.S.C. § 119(a), this application claims the benefit of earlier filing date and right of priority to Korean Patent Application No. 10-2015-0187794, filed on Dec. 28, 2015, the contents of which are all hereby incorporated by reference herein in its entirety.

BACKGROUND OF THE INVENTION

1. Field of the Invention

This specification relates to a delay time generation apparatus for an air circuit breaker, and more particularly, a delay time generation apparatus for an air circuit breaker capable of improving reliability for a generation of a delay time in the air circuit breaker.

2. Background of the Invention

In general, a circuit breaker refers to an apparatus that opens and closes a load in a power system, a distribution system or an electric circuit and cuts off a current when an accident such as grounding or short-circuit occurs.

Some of such circuit breakers are provided with a relay executing a so-called making current release (MCR) function of setting a current value, detecting an introduced current and instantaneously blocking an introduction of a heavy current over the set current value, so as to prevent the introduction of the heavy current into a load side.

In order for the relay to execute the MCR function, a case of opening the circuit breaker for blocking a fault current (i.e., separating a fixed contactor and a movable contactor from each other) in a closed state of the circuit breaker should be distinguished from a case of blocking a fault current upon closing the circuit breaker (i.e., contacting the movable contactor contact with the fixed contactor) on a circuit which is already open due to an occurrence of a fault.

To distinguish the two cases, a delay time generation apparatus for a circuit breaker is used for outputting a contact signal (or conductive signal) with a predetermine delay time after the movable contactor is brought into contact with the fixed contactor.

Meanwhile, FIG. 1 is a schematic view illustrating a delay time generation apparatus for a circuit breaker according to the related art.

As illustrated in FIG. 1, the related art delay time generation apparatus includes a switch 20 disposed at one side of a main shaft 10 to output a signal upon detecting a contact state, a delay plate 30 rotatably disposed to be contactable with or separated from the switch 20, and a lever 12 integrally formed with the main shaft 10 to press the delay plate 30 upon a rotation of the main shaft 10 in a breaking direction, such that the delay plate 30 is rotated away from the switch 20.

The delay plate 30 includes a rotation shaft 31, a first arm 33 extending from the rotation shaft 31 toward the main shaft 10 and contactable with the lever 12, and a second arm 35 extending from the rotation shaft 31 toward the switch 20 and rotated simultaneously with the first arm 33 to be contactable with the switch 20.

In this instance, the second arm 35 is connected with a spring 37 that supplies an elastic force in a direction that the second arm 35 comes in contact with the switch 20.

Also, the second arm 35 is provided with a mass body 39 causing a predetermined delay time due to inertia upon a rotation of the main shaft 10 in a closing direction.

With the configuration, in a broke state of the circuit breaker, when the main shaft 10 is rotated in the closing direction, the delay plate 30 is rotated toward the switch 20 in a clockwise direction by the elastic force of the spring 37. In this instance, a predetermined delay time is generated during the rotation of the delay plate 30 due to the inertia of the mass body 39. The delay time is generated in response to the delay plate 30 being brought into contact with the switch 20 after the fixed contactor and the movable contactor are brought into contact with each other due to the rotation of the main shaft 10.

However, the related art delay time generation apparatus uses a large mass body, the apparatus increases in size which makes it difficult to install the generation apparatus in a narrow space.

Also, the generation of the delay time using the mass body brings about lowered accuracy of the delay time and difficulty in ensuring a sufficient delay time.

SUMMARY OF THE INVENTION

Therefore, to obviate those problems and other drawbacks of the related art, an aspect of the detailed description is to provide a delay time generation apparatus for an air circuit breaker, capable of improving reliability for a generation of a delay time of the air circuit breaker.

To achieve these and other advantages and in accordance with the purpose of this specification, as embodied and broadly described herein, there is provided a delay time generation apparatus for an air circuit breaker, for outputting a conductive signal through a switch with a preset delay time when a movable contactor is brought into contact with a fixed contactor, the apparatus including a pin portion moved downward when the movable contactor is brought into contact with the fixed contactor, a main shaft rotated in response to a movement of the movable contactor to a contact position or a trip position, a first rotating unit located to be closely adhered on the main shaft, the first rotating unit being released from the adhered state on the main shaft and rotated in a clockwise direction through the pin portion when the movable contactor is moved to the contact position, and rotated in a counterclockwise direction through the main shaft when the movable contactor is moved to the trip position, and a second rotating unit located below the first rotating unit, the second rotating unit being rotated in response to the rotation of the first rotating unit to be brought into contact with or separated from the switch such that the conductive signal is output.

Also, the apparatus may further include a spring member having one side connected to the second rotating unit, to apply an elastic force to the second rotating unit to be rotated in the clockwise direction such that the second rotating unit and the switch are separated from each other, when the movable contactor is located at the trip position. Here, a connected portion between the spring member and the second rotating unit may be changed in response to the rotation of the second rotating unit when the movable contactor is moved to the contact position, and thus the spring member applies the elastic force to the second rotating unit to be rotated in the counterclockwise direction such that the second rotating unit is brought into contact with the switch.

The first rotating unit may include a body portion having connection arms extending from both sides thereof in a bent manner to be connected to an inside of the air circuit breaker, a holder located between the connection arms and pushed down by the pin portion when the movable contactor is moved to the contact position, a rotation adjusting plate extending from a lower end of a side surface of the body portion toward the second rotating unit, wherein the rotating adjusting plate pushes the second rotating unit, in response to the rotation of the body portion, such that the second rotating unit is brought into contact with the switch, when the movable contactor is moved to the contact position, and wherein the rotation adjusting plate rotates the second rotating unit, in response to the rotation of the body portion, such that the second rotating unit is separated from the switch, when the movable contactor is moved to the trip position, and a stopping portion extending from a lower end of the body portion toward the main shaft, and brought into contact with the main shaft to rotate the body portion when the movable contactor is moved to the trip position.

The stopping portion may include an extending plate extending from the lower end of the body portion toward the main shaft, and an adhering plate extending downwardly from a front end of the extending plate in a bent manner, and brought into contact with the main shaft in response to the rotation of the main shaft.

The holder may be provided with protrusion protruding upwardly from an upper end thereof and preventing shaking of the pin portion upon being closely adhered on the pin portion.

The second rotating unit may include a first rotating plate located below the first rotating unit, and rotated by the rotation adjusting plate to be brought into contact with the switch when the movable contactor is moved to the contact position, and a second rotating plate extending from one side of the first rotating plate toward the first rotating unit, and rotated by the rotation adjusting plate such that the first rotating plate is separated from the switch when the movable contactor is moved to the trip position.

The main shaft may be provided with a protruding portion protruding toward the first rotating unit, the protruding portion pushing the stopping portion to rotate the first rotating unit, such that the second rotating unit is rotated in response to the rotation of the first rotating unit to be separated from the switch when the movable contactor is moved to the trip position.

The second rotating plate may be inwardly bent by a predetermined angle.

The first rotating plate may be provided with a connecting plate disposed on one side thereof and having an insertion hole in which one side of the spring member is inserted.

The first rotating plate may be provided with a hinge portion disposed on another side thereof and connected to an inside of the air circuit breaker.

The pin portion may be provided with a pressing plate disposed on a lower end thereof to press the first rotating unit in response to a movement of the pin portion.

A delay time generation apparatus for an air circuit breaker according to the present invention can provide an effect of ensuring a delay time as long as possible even in a narrow space upon outputting a signal related to a conductive state, by virtue of interaction of a main shaft, a pin portion, a first rotating unit, a second rotating unit and a spring member.

Also, a simplified structure of the apparatus may result in a reduction of a fabrication time, a simplification of fabricating processes and a reduction of fabricating costs.

The spring member may apply an elastic force in the same direction as a rotating direction of the second rotating unit. This may prevent the second rotating unit from being re-rotated in an opposite direction to the rotating direction due to a collision against another component of the air circuit breaker.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given of a delay time generation apparatus for an air circuit breaker in detail according to one embodiment disclosed herein, with reference to the accompanying drawings.

Figure 1:
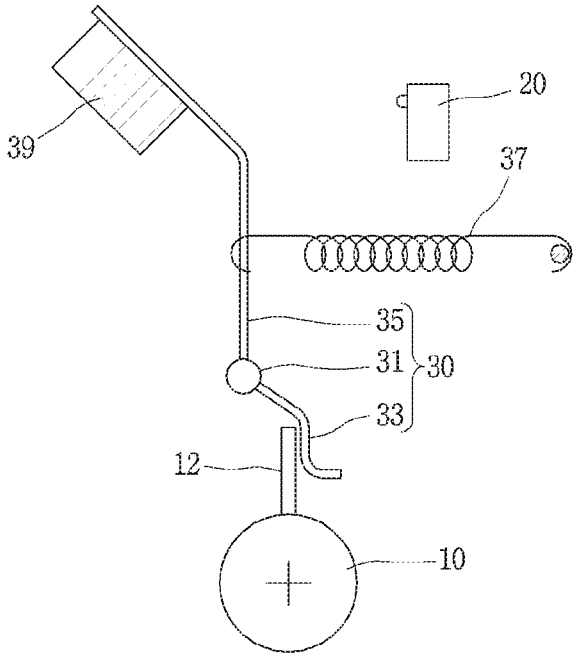
FIG. 1 RELATED ART
FIG. 1 is a schematic view illustrating a delay time generation apparatus for a circuit breaker according to the related art.
Figure 2:
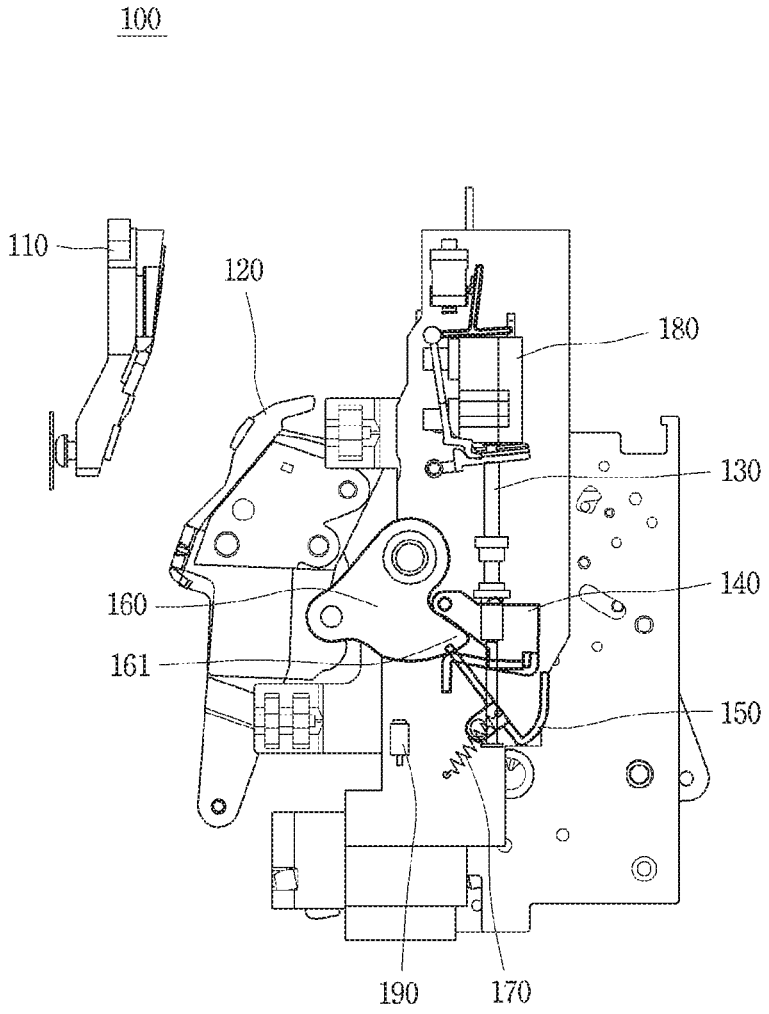
FIG. 2 is a schematic view in a trip state of a delay time generation apparatus provided in an air circuit breaker in accordance with the present invention.
Figure 3:
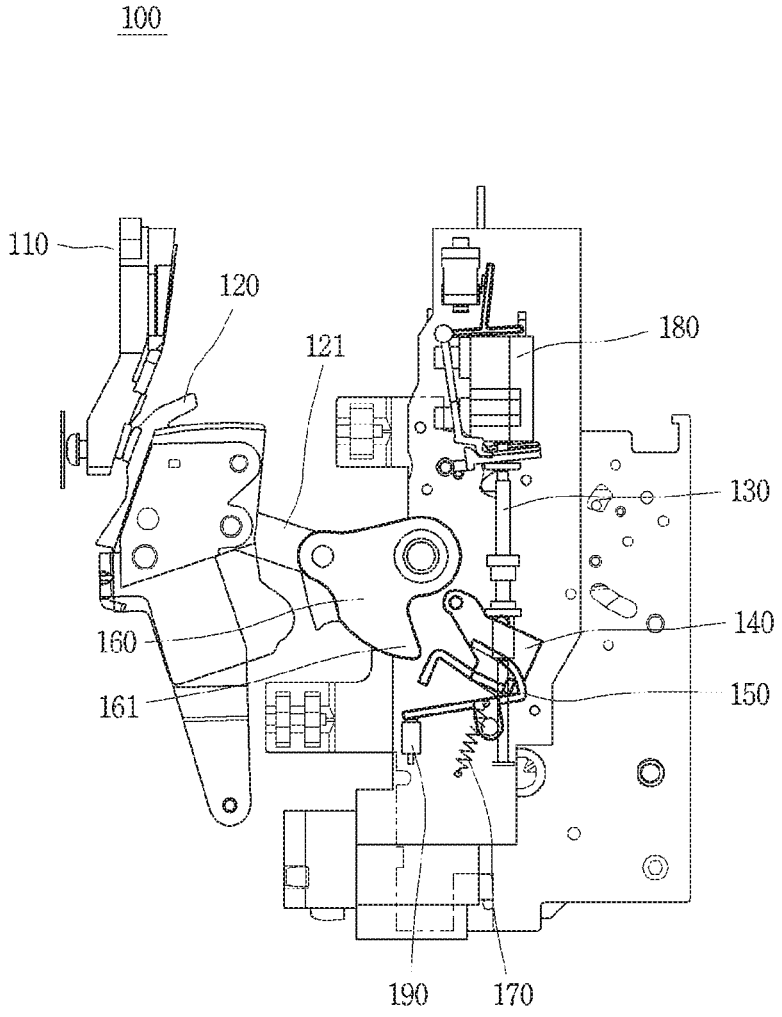
FIG. 3 is a schematic view in a contact state (current-flowing state) of the delay time generation apparatus provided in the air circuit breaker in accordance with the present invention.
Figure 4A:
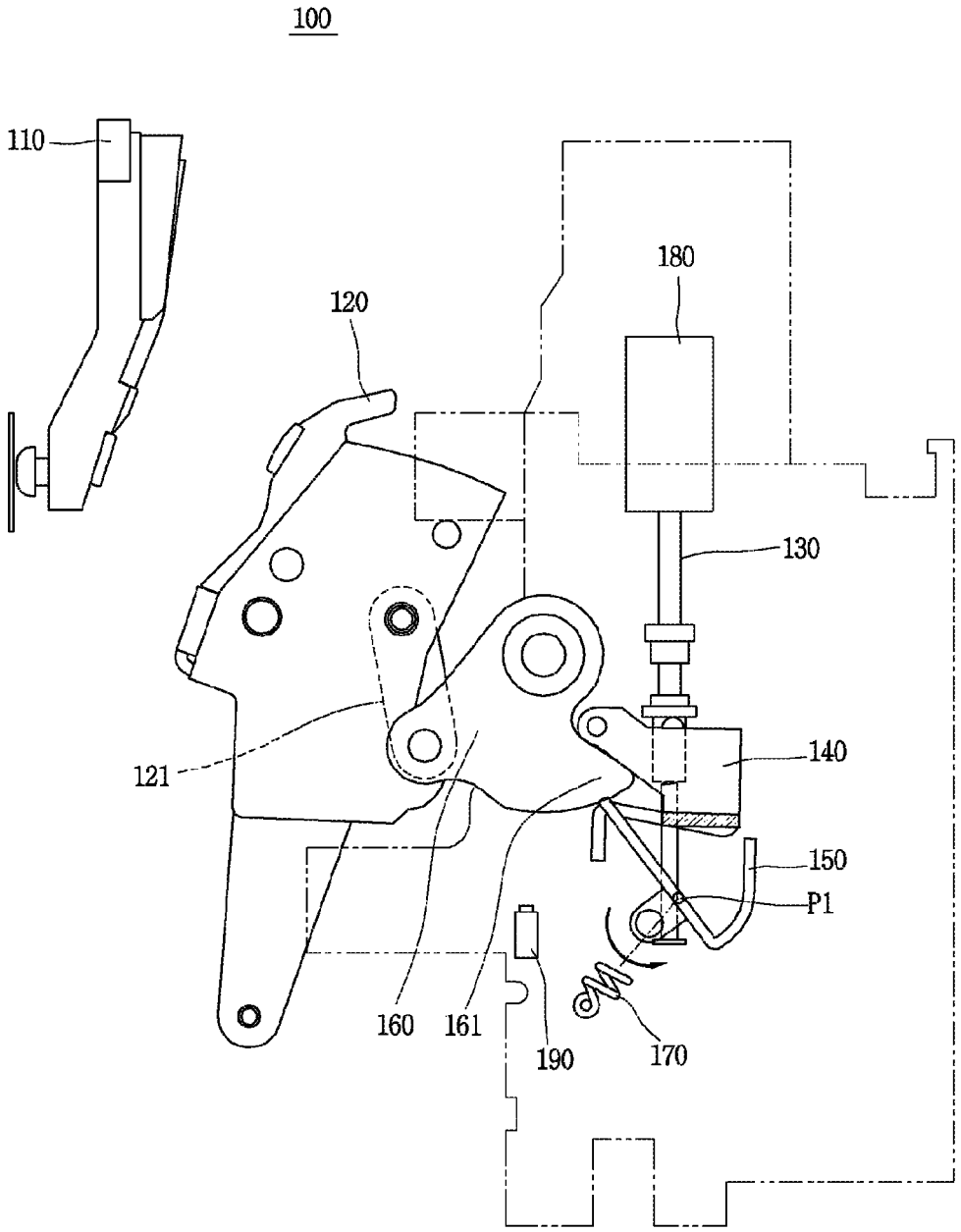
FIG. 4A is a schematic view illustrating a state that a current starts to flow in the air circuit breaker in accordance with the present invention.
Figure 4B:
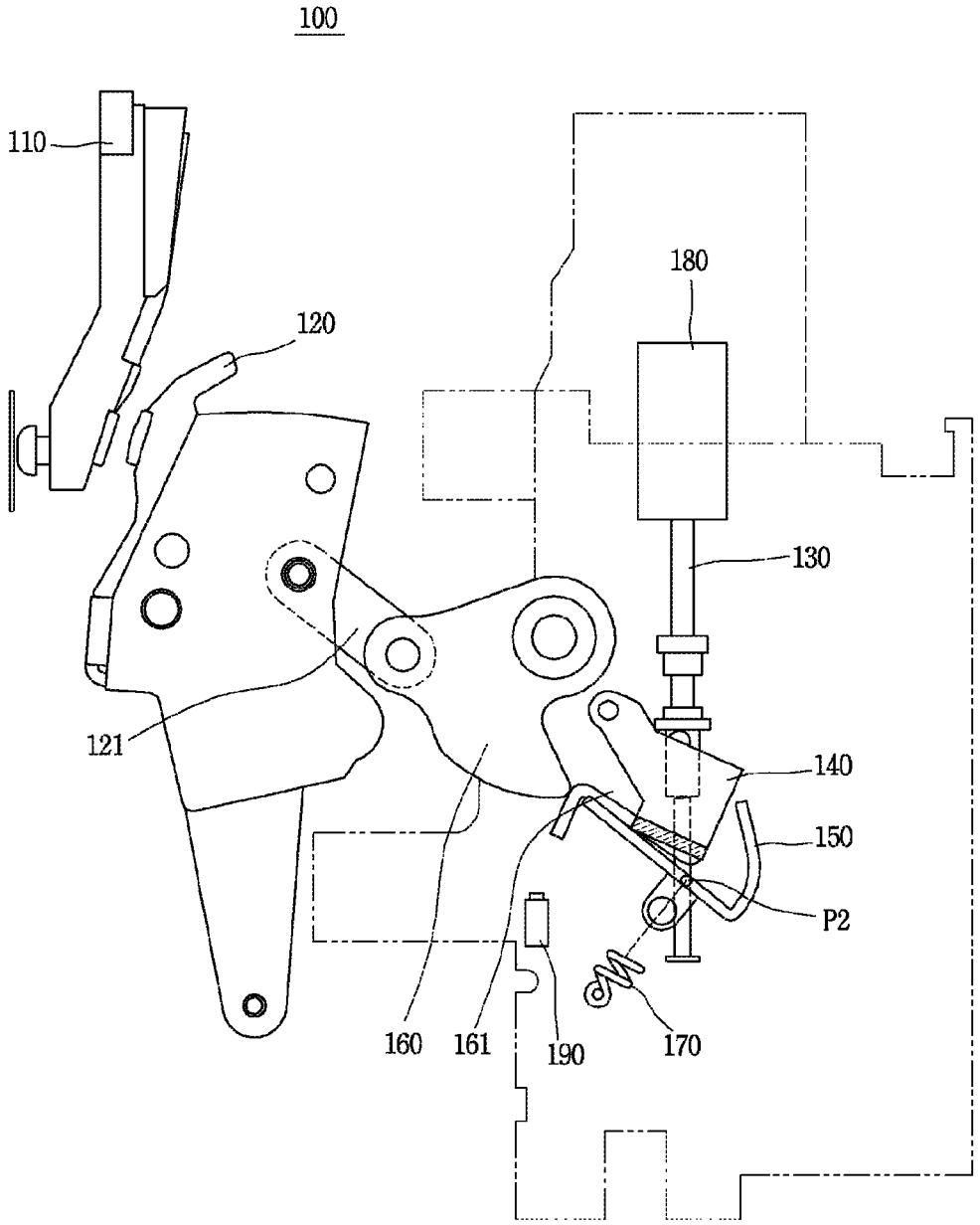
FIG. 4B is a schematic view illustrating a state just before a current flows in the air circuit breaker in accordance with the present invention.
Figure 4C:
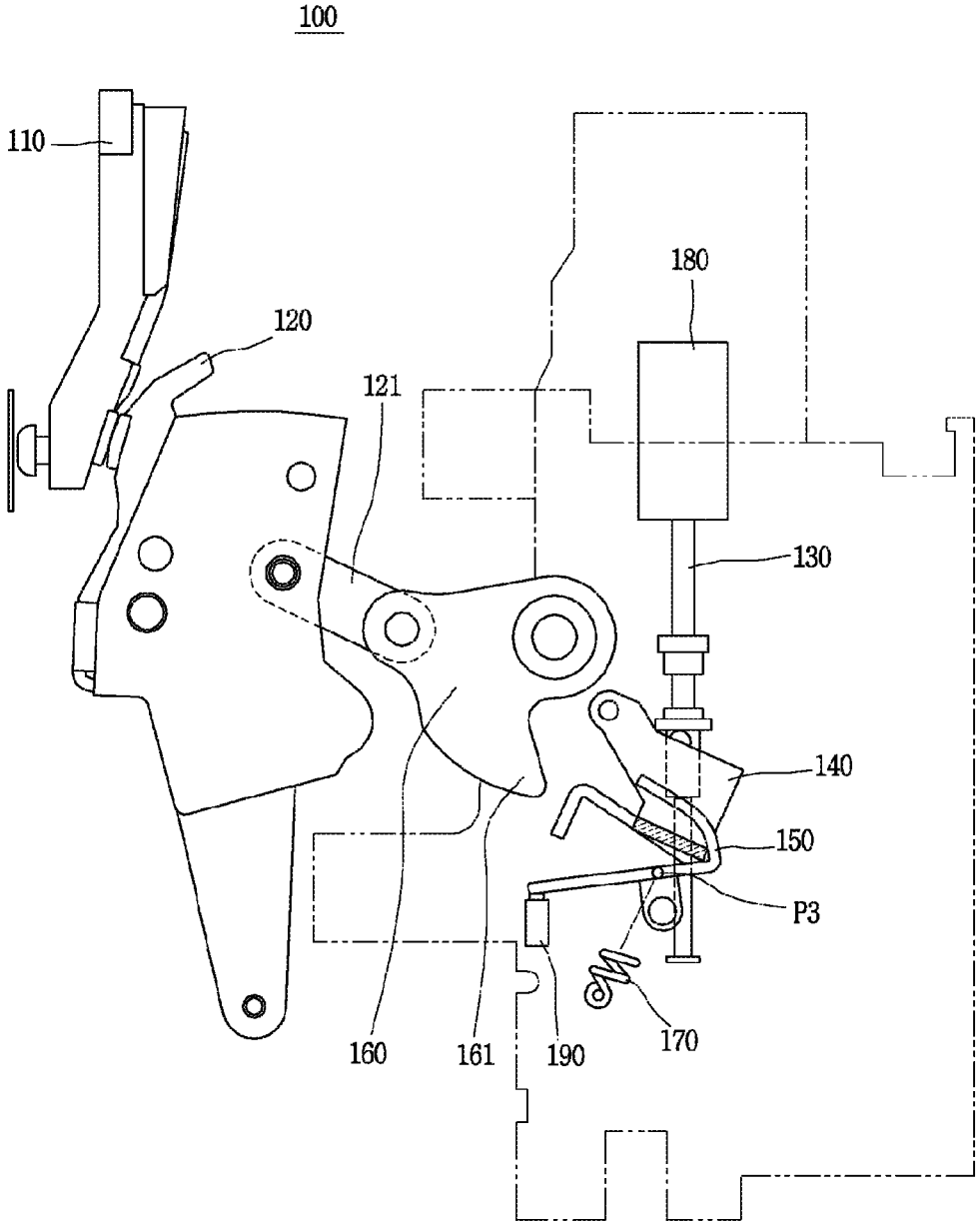
FIG. 4C is a schematic view illustrating a state that a current flows in the air circuit breaker in accordance with the present invention.

FIG. 2 is a schematic view in a trip state of a delay time generation apparatus provided in an air circuit breaker in accordance with the present invention, FIG. 3 is a schematic view in a contact state (current-flowing state) of the delay time generation apparatus provided in the air circuit breaker in accordance with the present invention, FIG. 4A is a schematic view illustrating a state that a current starts to flow in the air circuit breaker in accordance with the present invention, FIG. 4B is a schematic view illustrating a state just before a current flows in the air circuit breaker in accordance with the present invention, and FIG. 4C is a schematic view illustrating a state that a current flows in the air circuit breaker in accordance with the present invention.

Figure 5:
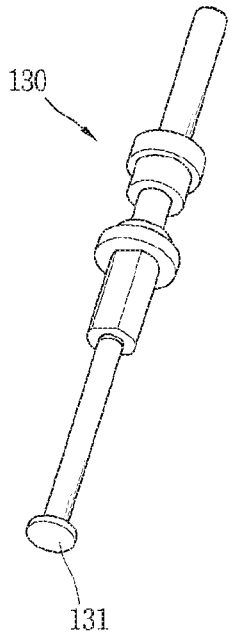
FIG. 5 is a perspective view illustrating a pin portion provided in the delay time generation apparatus for the air circuit breaker in accordance with the present invention.
Figure 6:
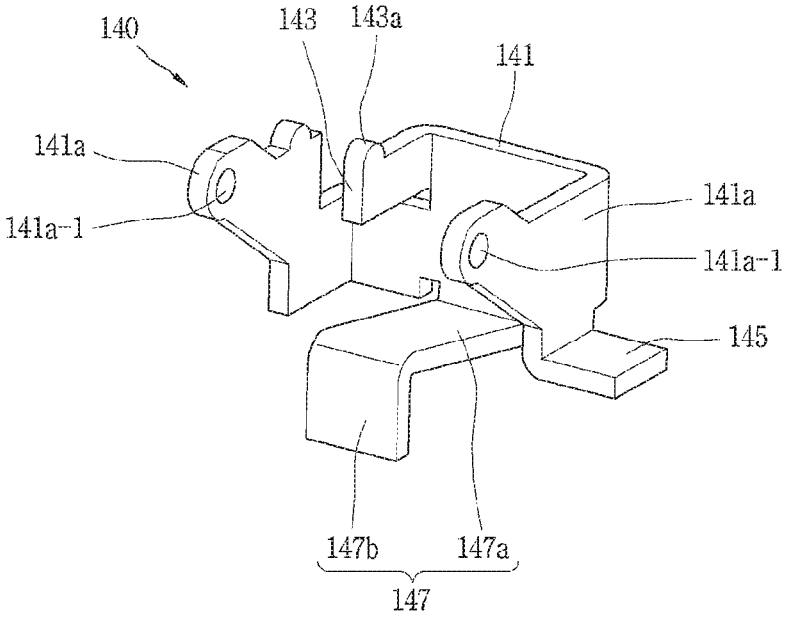
FIG. 6 is a perspective view illustrating a first rotating unit provided in the delay time generation apparatus for the air circuit breaker in accordance with the present invention.
Figure 7:
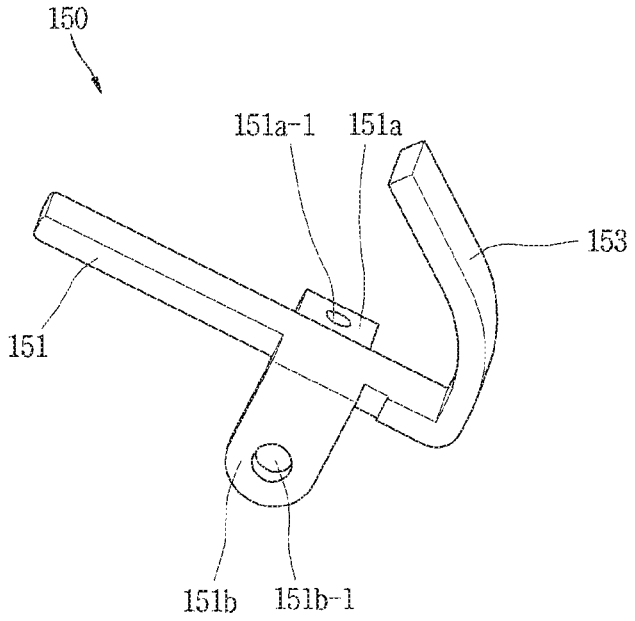
FIG. 7 is a perspective view illustrating a second rotating unit provided in the delay time generation apparatus for the air circuit breaker in accordance with the present invention.

Also, FIG. 5 is a perspective view illustrating a pin portion provided in the delay time generation apparatus for the air circuit breaker in accordance with the present invention, FIG. 6 is a perspective view illustrating a first rotating unit provided in the delay time generation apparatus for the air circuit breaker in accordance with the present invention, and FIG. 7 is a perspective view illustrating a second rotating unit provided in the delay time generation apparatus for the air circuit breaker in accordance with the present invention.

As illustrated in FIGS. 2 and 3, an air circuit breaker 100 according to the present invention is provided with a delay time generation apparatus that outputs a conductive signal (or contact signal) through a switch 190 with a predetermined delay time while a movable contactor 120 is brought into contact with a fixed contactor 110.

In this instance, the delay time generation apparatus includes a pin portion 130, a main shaft 160, a first rotating unit 140 and a second rotating unit 150.

The pin portion 130 is moved down in response to an operation of an actuator 180 to push down the first rotating unit 140 and rotate the first rotating unit 140 when the movable contactor 120 and the fixed contactor 110 are in a contact state.

In this instance, as illustrated in FIG. 5, the pin portion 130 is further provided with a pressing plate 131 on a lower end thereof. Thus, as the pin portion 130 is moved, the pressing plate 131 presses the first rotating unit 140 to be rotated.

The main shaft 160 is rotatably connected with the movable contactor 120 through a connection link 121. When the movable contactor 120 is moved to a contact position (or conductive position) or a trip position, the main shaft 160 is rotated in a clockwise or counterclockwise direction, to be spaced apart from or closely adhered on the first rotating unit 140.

The first rotating unit 140 is located adjacent to the main shaft 160. When the movable contactor 120 is moved to the contact position, the close adhesion of the first rotating unit 140 on the main shaft 160 is released and the first rotating unit 140 is rotated in the clockwise direction through the pin portion 130. On the other hand, when the movable contactor 120 is moved to the trip position, the first rotating unit 140 is rotated in the counterclockwise direction through the main shaft 160.

The second rotating unit 150 is located below the first rotating unit 140. The second rotating unit 150 is rotated, in response to the rotation of the first rotating unit 140, to be brought into contact with or separated from the switch 190. Accordingly, a conductive signal is output with a predetermined delay time.

In this instance, the delay time generation apparatus may further be provided with a spring member 170. The spring member 170 has one side connected to the second rotating unit 150. Accordingly, when the movable contactor 150 is moved to the trip position, the spring member 170 applies an elastic force to the second rotating unit 150 such that the second rotating unit 150 is rotated in the clockwise direction to be separated from the switch 190. On the other hand, when the movable contactor 120 is moved to the contact position, a connected position between the spring member 170 and the second rotating unit 150 is changed in response to the rotation of the second rotating unit 150. Accordingly, the spring member 170 applies the elastic force to the second rotating unit 150 to be rotated in the counterclockwise direction, such that the second rotating unit 150 is brought into contact with the switch 190.

Meanwhile, as illustrated in FIG. 6, the first rotating unit 140 includes a body portion 141, a holder 143, a rotation adjusting plate 145 and a stopping portion 147.

The body portion 141 is provided on both sides thereof with connection arms 141*a* each with a through hole 141*a*-1. The connection arms 141*a* extend from the both sides of the body portion 141 in a bent manner to be connected to an inside of the air circuit breaker 100.

The holder 143 is located between the connection arms 141*a*. When the movable contactor 120 is moved to the contact position, the holder 143 receives a force downwardly applied through the pin portion 130.

In this instance, a protrusion 143*a* protrudes upwardly from an upper end of the holder 143, so as to prevent shaking of the pin portion 130 when being closely adhered on the pin portion 130.

The rotation adjusting plate 145 extends from a lower end of a side surface of the body portion 141 toward the second rotating unit 150. When the movable contactor 120 is moved to the trip position, the rotation adjusting plate 145 rotates the second rotating unit 150 in the clockwise direction, in response to the rotation of the body portion 141, such that the second rotating unit 150 is separated from the switch 190. On the other hand, when the movable contactor 120 is moved to the contact position, the rotation adjusting plate 145 rotates the second rotating unit 150 in the counterclockwise direction, in response to the rotation of the body portion 141, such that the second rotating unit 150 is brought into contact with the switch 190.

The stopping portion 147 extends from a lower end of the body portion 141 toward the main shaft 160. When the movable contactor 120 is moved to the trip position, the stopping portion 147 is brought into contact with the main shaft 160, such that the body portion 141 is rotated.

In this instance, the stopping portion 147 is provided with an extending plate 147*a* and an adhering plate 147*b*.

The extending plate 147*a* extends from the lower end of the body portion 141 toward the main shaft 160.

The adhering plate 147*b* extends downwardly from a front end of the extending plate 147*a* in a bent manner. Accordingly, the adhering plate 147*b* is brought into contact with the main shaft 160, in response to the rotation of the main shaft 160, thereby rotating the first rotating unit 140.

Meanwhile, as illustrated in FIG. 7, the second rotating unit 150 includes a first rotating plate 151 and a second rotating plate 153.

The first rotating plate 151 is located below the first rotating unit 140. When the movable contactor 120 is moved to the contact position, the first rotating plate 151 is rotated by the rotation adjusting plate 145 to be brought into contact with the switch 190.

The second rotating plate 153 extends from one side of the first rotating plate 151 toward the first rotating unit 140. When the movable contactor 120 is moved to the trip position, the second rotating plate 153 is rotated by the rotation adjusting plate 145 such that the first rotating plate 151 is separated from the switch 190.

In this instance, the second rotating plate 153 is curved inwardly. Accordingly, when the movable contactor 120 is moved to the contact position and thus the first rotating plate 151 is in the contact state with the switch 190, the second rotating plate 153 is located above the rotation adjusting plate 145 in a covering manner.

Therefore, when the first rotating unit 140 is rotated in response to the movement of the movable contactor 120 to the trip position, the second rotation plate 153 is rotated by the rotation adjusting plate 145 such that the first rotating plate 151 is separated from the switch 190.

In addition, a connecting plate 151*a* with an insertion hole 151*a*-1 in which one side of the spring member 170 is inserted is further provided on one side of the first rotating plate 151, and a hinge portion 151*b* connected to the inside of the air circuit breaker 100 is further provided on another side of the first rotating plate 151.

Therefore, the spring member 170 is connected to the connecting plate 151*a* through the insertion hole 151*a*-1 to supply an elastic force to the first rotating plate 151, and the first rotating plate 151 is rotated by being connected into the air circuit breaker 100 through a coupling hole 151*b*-1 formed through the hinge portion 151*b*.

Meanwhile, the main shaft 160 is provided with a protruding portion 161 protruding toward the first rotating unit 140. When the movable contactor 120 is moved to the trip position, the protruding portion 161 pushes the stopping portion 147 to rotate the first rotating unit 140, and the second rotating unit 150 is rotated in response to the rotation of the first rotating unit 140, so as to be separated from the switch 190.

Hereinafter, an operation of the delay time generation apparatus for the air circuit breaker according to the present invention will be described in detail with reference to the accompanying drawings.

First, as illustrated in FIG. 4A, when the movable contactor 120 is located at the trip position, the first rotating unit 140 is in a contact state with an upper end of the protruding portion 161 of the main shaft 160, and the pin portion 130 is located on an upper end of the first rotating unit 140.

In this instance, as illustrated in FIG. 4B, when the movable contactor 120 is moved to the contact position, the main shaft 160 which is connected with the movable contactor 120 through the connection link 121 is rotated in the clockwise direction, thereby releasing the contact state between the protruding portion 161 and the first rotating unit 140.

Also, as illustrated in FIG. 4C, when the movable contactor 120 is brought into contact with the fixed contactor 110, the pin portion 130 is moved downward by an operation of the actuator 180 to push down the first rotating unit 140. Accordingly, the first rotating unit 140 is rotated in the clockwise direction.

Also, when the first rotating unit 140 is rotated in the clockwise direction, the rotation adjusting plate 145 provided on the first rotating unit 140 pushes the first rotating plate 151 of the second rotating unit 150 located below the rotation adjusting plate 145, such that the second rotating unit 150 is rotated in the counterclockwise direction. Accordingly, the first rotating plate 151 is brought into contact with the switch 190.

In this instance, the spring member 170 located below the second rotating unit 150 and connected to the first rotating plate 151 applies an elastic force to the second rotating unit 150 in the clockwise direction when the movable contactor 120 is in a trip state. However, when the movable contactor 120 is moved to the contact position, a connected portion between the spring member 170 and the first rotating plate 151 is moved from a portion P1 to portions P2 and P3 in a sequential manner, in response to the rotation of the second rotating unit 150. Accordingly, when the first rotating plate 151 is finally brought into contact with the switch 190, the spring member 170 applies the elastic force to the second rotating unit 150 to be rotated in the counterclockwise direction, thereby maintaining the contact state between the first rotating plate 151 and the switch 190.

Also, a load of the spring member 170 may be adjusted in the range of 1.5 kgf to 2.5 kgf, to ensure a delay time as long as possible within a narrow space.

Through such processes, after a preset time is delayed in the contact state between the movable contactor 120 and the fixed contactor 110, the conductive signal is output through the switch 190.

Meanwhile, when the movable contactor 120 is moved from the contact position to the trip position, the main shaft 160 connected to the movable contactor 120 through the connection link 121 is rotated in the counterclockwise direction. Accordingly, the protruding portion 161 formed on the main shaft 160 pushes the stopping portion 147 provided on the first rotating unit 140 and thereby the first rotating unit 140 is rotated in the counterclockwise direction.

Also, the rotation adjusting plate 145 provided on the first rotating unit 140 is then brought into contact with the second rotating plate 153 provided on the second rotating unit 150 and thus the second rotating unit 150 is rotated in the clockwise direction, thereby separating the first rotating plate 151 from the switch 90.

In this instance, while the first rotating plate 151 and the switch 190 are in the contact state, the contact state is maintained by virtue of the elastic force applied by the spring member 170 to rotate the first rotating plate 151 in the counterclockwise direction. On the other hand, when the first rotating plate 151 is separated from the switch 190 in response to the movement of the movable contactor 120 to the trip position, the connected portion between the first rotating plate 151 and the spring member 170 is moved from the portion P3 to the portion P1. Accordingly, the separate state between the first rotating plate 151 and the switch 190 is maintained by the elastic force finally applied by the spring member 170 to rotate the first rotating plate 151 in the clockwise direction.

The delay time generation apparatus for the air circuit breaker according to the present invention having the configuration can ensure a delay time as long as possible even within a narrow space upon outputting a signal related to a conductive state, by virtue of interaction of the main shaft 160, the pin portion 130, the first rotating unit 140, the second rotating unit 150 and the spring member 170.

Also, a simplified structure of the apparatus may result in a reduction of a fabrication time, a simplification of fabricating processes and a reduction of fabricating costs.

The spring member 170 may apply the elastic force in the same direction as the rotating direction of the second rotating unit 150. This may prevent the second rotating unit 150 from being re-rotated in an opposite direction to the rotating direction due to a collision against another component of the air circuit breaker.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A delay time generation apparatus for an air circuit breaker that outputs a conductive signal through a switch with a preset delay time when a movable contactor contacts a fixed contactor, the apparatus comprising:

a pin portion moved downward when the movable contactor contacts the fixed contactor;

a main shaft rotated to a contact position or a trip position in response to movement of the movable contactor;

a first rotating unit on the main shaft, the first rotating unit released from a state in which it is adhered to the main shaft and rotated in a clockwise direction through the pin portion when the movable contactor is moved to the contact position and in a counterclockwise direction through the main shaft when the movable contactor is moved to the trip position; and a second rotating unit below the first rotating unit, the second rotating unit rotated in response to rotation of the first rotating unit such that it contacts or separates from the switch in order to output the conductive signal, wherein a lower end of the pin portion includes a pressing plate that presses the first rotating unit in response to movement of the pin portion.

2. The apparatus of claim 1, further comprising a spring member having one side connected to the second rotating unit in order to apply an elastic force to cause the second rotating unit to rotate clockwise when the movable contactor is located at the trip position such that the second rotating unit and the switch are separated from each other, wherein a connected portion between the spring member and the second rotating unit changes in response to rotation of the second rotating unit when the movable contactor is moved to the contact position such that the spring member applies the elastic force to cause the second rotating unit to rotate counterclockwise and contact the switch.

3. The apparatus of claim 1, wherein the first rotating unit comprises:

a body portion having bent connection arms extending from both sides for connection to an inside of the air circuit breaker;

a holder between the connection arms, the holder pushed down by the pin portion when the movable contactor is moved to the contact position;

a rotation adjusting plate extending toward the second rotating unit from a lower end of a side surface of the body portion, wherein the rotation adjusting plate pushes the second rotating unit in response to rotation of the body portion such that the second rotating unit contacts the switch when the movable contactor is moved to the contact position and the rotation adjusting plate rotates the second rotating unit in response to rotation of the body portion such that the second rotating unit is separated from the switch when the movable contactor is moved to the trip position; and a stopping portion extending from a lower end of the body portion toward the main shaft, the stopping portion contacting the main shaft in order to rotate the body portion when the movable contactor is moved to the trip position.

4. The apparatus of claim 3, wherein the stopping portion comprises:

an extending plate extending toward the main shaft from the lower end of the body portion; and an bent adhering plate extending downward from a front end of the extending plate, the adhering plate contacting the main shaft in response to rotation of the main shaft.

5. The apparatus of claim 3, wherein an upper end of the holder comprises an upward protrusion that prevents shaking of the pin portion when the holder is adhered to the pin portion.

6. The apparatus of claim 3, wherein the second rotating unit comprises:

a first rotating plate below the first rotating unit, the first rotating plate rotated by the rotation adjusting plate and contacting the switch when the movable contactor is moved to the contact position; and a second rotating plate extending toward the first rotating unit from one side of the first rotating plate, the second rotating plate rotated by the rotation adjusting plate and separated from the switch when the movable contactor is moved to the trip position.

7. The apparatus of claim 3, wherein the main shaft comprises a protruding portion protruding toward the first rotating unit, the protruding portion pushing the stopping portion to rotate the first rotating unit such that the second rotating unit rotates and separates from the switch when the movable contactor is moved to the trip position.

8. The apparatus of claim 6, wherein the second rotating plate is inwardly bent by a predetermined angle.

9. The apparatus of claim 6, wherein a first side of the first rotating plate comprises a connecting plate having an insertion hole through which one side of the spring member is inserted.

10. The apparatus of claim 9, wherein a second side of the first rotating plate comprises a hinge portion connected to an inside of the air circuit breaker.

* * * * *